United States Patent [19]

Macpherson

[11] 4,068,825

[45] Jan. 17, 1978

[54] DOUBLE PARALLELOGRAM JACK

[76] Inventor: Roger Macpherson, 183 Pleasant Way, Penfield, N.Y. 14526

[21] Appl. No.: 735,164

[22] Filed: Oct. 26, 1976

[51] Int. Cl.[2] ..... B66F 3/00

[52] U.S. Cl. ..... 254/124

[58] Field of Search ..... 254/9 R, 9 B, 9 C, 122, 254/124, 126

[56] References Cited

U.S. PATENT DOCUMENTS

| | | | |
|---|---|---|---|
| 2,507,769 | 5/1950 | Churchill | 254/122 |
| 2,587,094 | 2/1952 | Berg et al. | 254/122 |
| 2,621,021 | 12/1952 | Dahl et al. | 254/122 |

*Primary Examiner*—Al Lawrence Smith
*Assistant Examiner*—Robert C. Watson

[57] ABSTRACT

A load-bearing plate is mounted by a plurality of pivotal links above a base plate, and solely for vertical movement toward and away from the base plate. An intermediate frame including two, spaced, parallel side bars is supported by the links between the two plates for swinging movement on the base plate about a pair of spaced, parallel axes. Driving means, such as a hydraulic screw jack is mounted between the two side bars for swinging movement therewith, and has a reciprocable piston rod attached to one of two, parallel shafts mounted at opposite ends in slots in the side bars to reciprocate longitudinally of the bars during the raising and lowering of the load-bearing plate. The reciprocable movement of the two shafts oscillates the links which in turn cause the load-bearing plate to reciprocate only vertically relative to the base plate.

10 Claims, 5 Drawing Figures

DOUBLE PARALLELOGRAM JACK

This invention relates to jacks, and more particularly to an improved hydraulic jack having a load-supporting platform which rises and falls vertically without any lateral movement in horizontal direction.

Most hydraulic jacks, such as those used as automobile jacks or the like, comprise a load-bearing plate or support which is mounted to pivot upwardly about a stationary pin or shaft, so that the support will move both vertically and laterally during the raising and lowering thereof. For this reason it is not uncommon to mount such jacks on wheels, so that as the load-bearing plate moves upwardly beneath a load the entire jack will be free to shift or roll on its wheels forwardly or rearwardly in a horizontal direction to compensate for the torque or lateral loading factor which results from the swinging movement of the load-bearing plate.

It is, of course, possible to produce a hydraulic jack which has its operating cylinder disposed in a vertical position so that the load-bearing plate will be moved directly vertically in response to the reciprocation of the associated piston rod of the cylinder. However, this design minimizes to a great extent the utility of the jack, because when the load-bearing plate is in its lowermost position it is supported on the upper end of the fully retracted piston rod, so that as a practical matter it is not possible to lower the load-bearing surface far enough to enable it to be used on items which have relatively low clearances, for example extremely low-swung automobile frames.

It is an object of this invention, therefore, to provide an improved hydraulic jack which obviates the advantages of prior hydraulic jacks of the type which utilize pivotal load-bearing supports, or vertically disposed cylinders for operating the jacks.

A more specific object of this invention is to provide a hydraulically operated jack which is capable of being collapsed to an extremely low position, and yet which is capable of being readily elevated to an operating height several times the height of its lowermost position.

A further object of this invention is to provide an improved hydraulic jack of the type described, which utilizes a plurality of pivotally-connected links that form two, collapsible, parallelogram-shaped sections mounted one above the other for operation by a cylinder which is disposed horizontally between them.

Still another object of this invention is to provide an improved hydraulic jack of the type described in which the operating cylinder is mounted within the collapsible frame for both vertical and lateral movement during the operation of the jack, while the upper, lower-bearing surface of the jack is mounted to move only vertically during such operations.

Other objects of the invention will be apparent hereinafter from the specification and from the recital of the appended claims, particularly when read in conjunction with the accompanying drawings.

Figure 1:
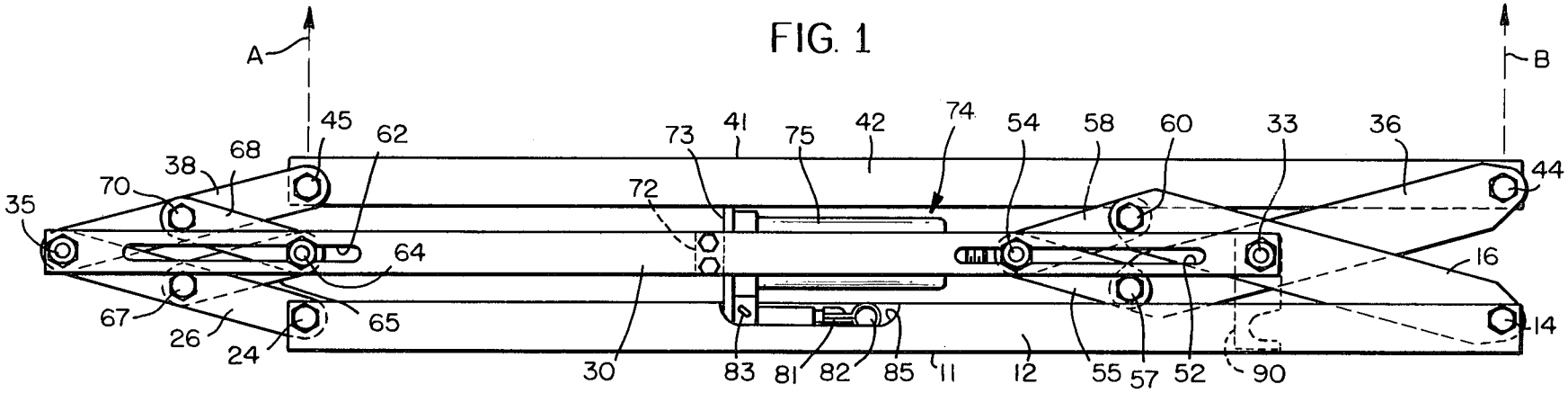
FIG. 1 is a front elevational view of a hydraulic jack made in accordance with one embodiment of this invention, the jack being illustrated in its lowermost or completely collapsed position.

Referring now to the drawings by numerals of reference, 10 denotes generally a collapsible jack frame made according to one embodiment of this invention, and comprising a base plate 11 having upstanding, parallel flanges 12 and 13 extending along opposite sides thereof. Pivotally mounted at their lower ends by bolts 14 to the flanges 12 and 13 at the right end of plate 11 (FIGS. 1 and 2) are two identical metal links 16 and 17, respectively, each of which swings at its lower end along the inside surface of the respective flange 12 or 13. Pivotally mounted at their lower ends by bolts 24 to flanges 12 and 13 at the end of the base 11 remote from the links 16 and 17 are two further, identical links 26 and 27, respectively, which are somewhat shorter than the links 16 and 17.

Figure 2:
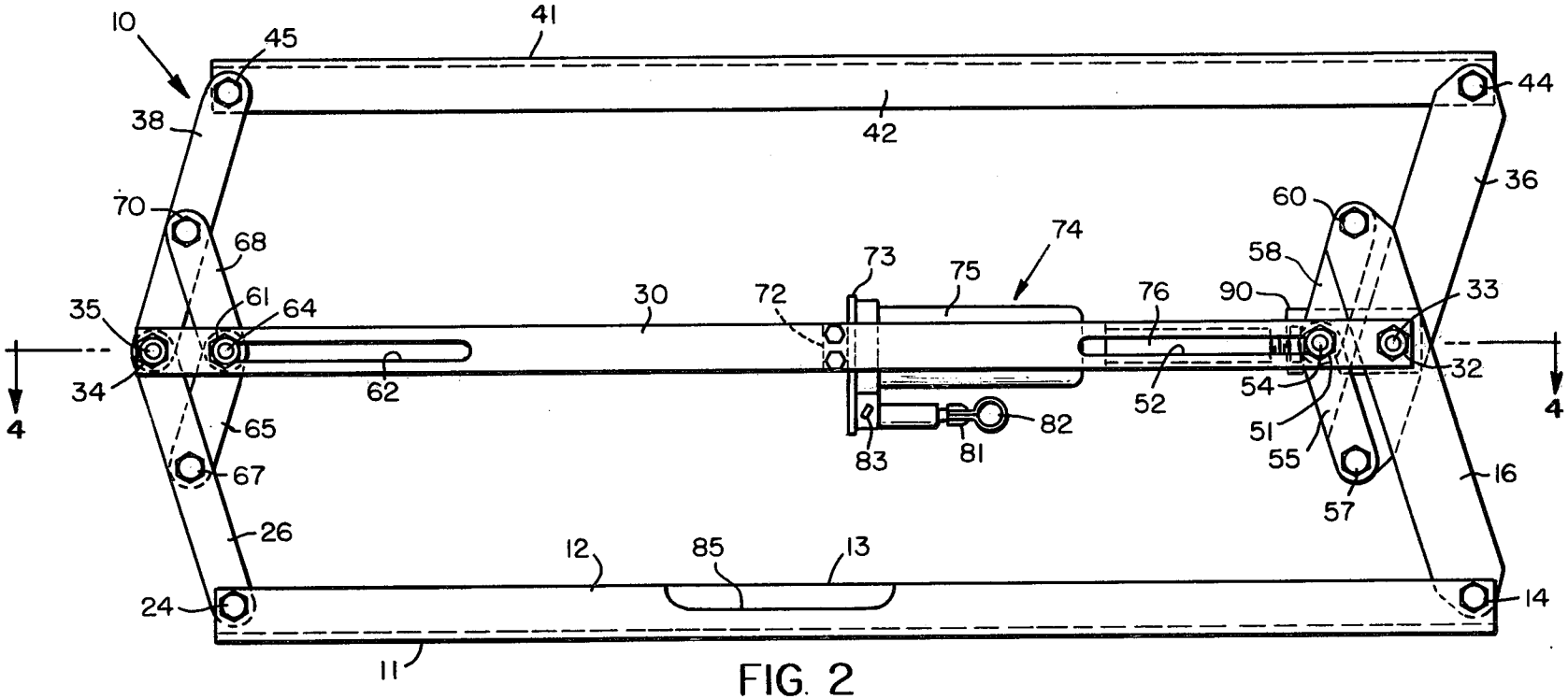
FIG. 2 is a view similar to FIG. 1, but illustrating the load-bearing surface of the jack elevated into its uppermost operating position.

Supported by the links 16, 17 and 26, 27 above and parallel to opposite sides of plate 11 are two elongate, rectangular metal side bars 30 and 31, which lie in the same vertical planes as the base plate flanges 12 and 13, respectively. At their right ends as illustrated in FIGS. 1 and 2 the bars 30 and 31 are pivotally connected by nuts 32 to opposite ends of a shaft 33, which has reduced-diameter end portions extending through registering openings in the links 16 and 17 beneath the upper ends thereof, and the adjacent ends of the bars 30 and 31. The opposite ends of the bars 30 and 31 are likewise pivotally connected by nuts 34 to opposite ends of a similar shaft 35, which, as in the case of shadft 33, has reduced-diameter ends projecting through registering openings in the upper ends of the link 26 and 27, and the left hand ends of the bars 30 and 31.

Pivotally connected intermediate their ends to opposite ends of shaft 33 for pivotal movement adjacent the inside surfaces of links 16 and 17, respectively, are two further, identical links 36 and 37. At the opposite end of frame 10 two identical links 38 and 39, which are shorter than links 36 and 37, are pivotally connected at their lower ends to opposite ends of the shaft 35 adjacent the inside surfaces of links 26 and 27, respectively.

Figure 3:
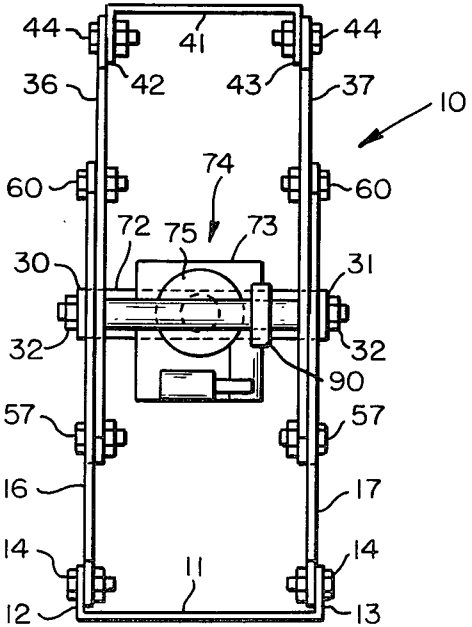
FIG. 3 is an end elevational view of this jack as shown in its fully extended position, as seen for example by looking at the right end of the jack as shown in FIG. 2.

Supported on the upper ends of the links 36, 37 and 38, 39 for movement in spaced, parallel relation to the base plate 11 is a load-bearing plate 41. Along its longitudinal side edges plate 41 has integral, downwardly projecting, parallel flanges 42 and 43 (FIG. 3) which are pivotally connected to the upper ends of the links 36 and 37 by bolts 44, and to the upper ends of the links 38 and 39 by bolts 45. Flanges 42 and 43 extend downwardly along the inside of the links 36, 37 and 38, 39 so that plate 41 is not quite as wide as the base plate 11.

Mounted at opposite ends thereof by nuts 51 for sliding movement in a pair of elongate slots 52 and 53 which are formed in the right hand ends of the side bars 30 and 31, respectively, is a cylindrical shaft or pin 54. Pin 54 is connected to the lower ends of the links 36 and 37 by two, rather short, identical links 55 and 56, the lower ends of which are pivotally connected to the lower ends of links 36 and 37, respectively, by the bolts 57. The upper ends of links 55 and 56 are pivotally connected to reduced-diameter portions of the shaft 54 adjacent opposite ends thereof to pivot thereabout adjacent the inside surfaces of the bars 30 and 31, respectively. Opposite ends of the shaft 54 are also connected to the upper ends of the links 16 and 17 by a pair of identical links 58 and 59, which are pivotally connected at their lower ends to opposite ends of shaft 54 adjacent the inside surfaces of the links 55 and 56, respectively, and which are pivotally connected at their upper ends by bolts 60 to the upper ends of links 16 and 17.

Mounted at opposite ends thereof by nuts 61 to reciprocate in registering slots 62 and 63 formed in the left hand ends of bars 30 and 31, respectively, is a further shaft or pin 64. Pin 64 is connected to links 26 and 27 by a pair of smaller, identical links 65 and 66, which are pivotally connected at their lower ends by bolts 67 to the links 26 and 27, respectively, approximately midway between opposite ends of the latter. At their upper ends links 65 and 66 are pivotally connected to reduced diameter portions of the shaft 64 adjacent opposite ends thereof. Shaft 64 is also connected to the links 38 and 39 by a further pair of, rather short, identical links 68 and 69, which are pivotally connected at their upper ends by bolts 70 to the links 38 and 39 intermediate the ends of the latter, and which are pivotally connected at their lower ends to opposite ends of shaft 64 adjacent the inside surfaces of bars 30 and 31.

Figure 4:
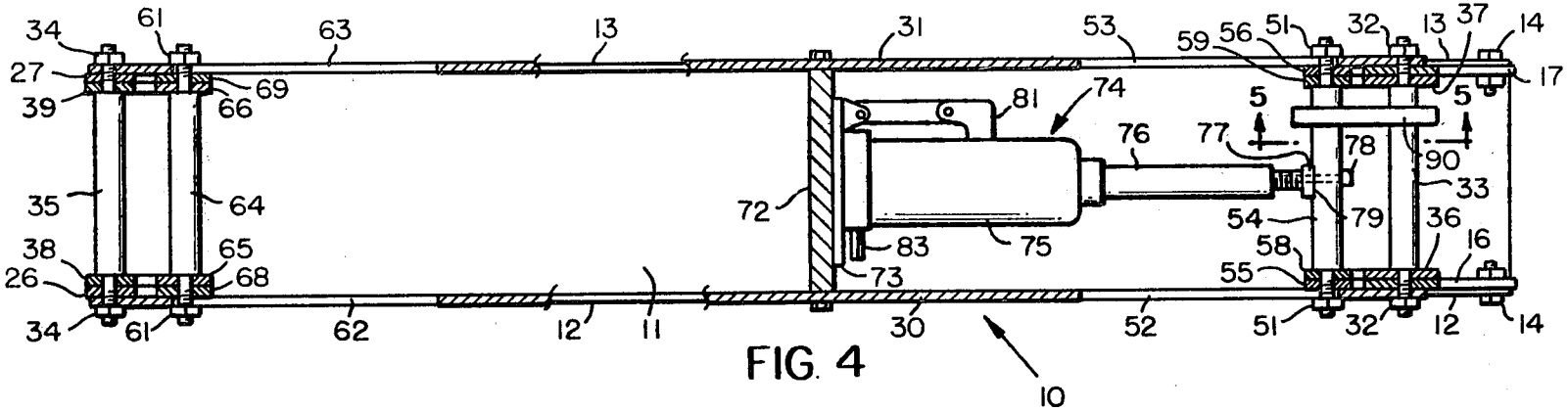
FIG. 4 is a fragmentary sectional view taken along the line 4—4 in FIG. 2 looking in the direction of the arrows.

Bolted or otherwise secured at opposite ends thereof to the inside surfaces of the bars 30 and 31, and extending normally therebetween at a point just to the right of center of these two bars is a rigid, metal support plate 72. The base 73 of a conventional, hydraulically operated screw jack, which is denoted generally at 74, is secured to the right hand side of the bar 72 so that the hydraulic cylinder 75 of the jack has its telescopic piston rod 76 facing the right end of frame 10 with itshorizontal axis intersecting the axis of the pin or shaft 54. The head 77, which is rotatably mounted on the outer, terminal end of the telescopic piston rod 76, is secured by a bolt 78 to the shaft 54, so that confronting, flat surfaces formed on the head 77 and the shaft 54, respectively, are seated against each other as at 79 (FIG. 4).

The jack 74 includes a conventional, pivotal operating arm 81, which extends laterally beneath the cylinder 75 and has in its outer end a socket or bore 82 for receiving the end of a removable operating rod (not illustrated), which is adapted to be inserted in a conventional manner in the socket 82 for use in manipulating the arm 81 as noted hereinafter. Also projecting forwardly from the base of cylinder 75 in the space between plates 11 and 41 is a generally rectangular, valve-operating handle 83 (FIG. 2 and 4), which is also adapted to be rotated by a conventional tool (not illustrated) between first and second positions, respectively, in one of which it allows hydraulic fluid to be pumped into cylinder 75, and in the other of which it allows the fluid to be exhausted from cylinder 75 as noted hereinafter.

Normally, when not in use, the valve 83 is rotated into a counterclockwise or released position as illustrated in FIG. 1, so that the valve (not illustrated) which operates the hydraulic jack 74, is in its exhaust position, whereby all the fluid has been exhausted from the cylinder 75 into the associated sump (not illustrated), so that the piston rod 76 is in its fully retracted position. Also as shown in FIG. 1, the upper edge of the flange 12 on the base plate 11 has therein an elongate scallop or notch 85, which registers with the socket 82 and the valve-operating arm 83 to allow access to these items when the collapsible frame 10 is in its lowermost (FIG. 1). At this time the retracted operating rod 76 of the jack 74 has drawn the attached pin or shaft 54 to its extreme left hand position in slots 52 and 53 in the side bars 30 and 31; and the pin 54 in turn, has caused the attached links 55, 56 and 58, 59 to pivot the attached ends of the longer links 16, 17 and 36, 37 into their fully collapsed positions about the axis of the shaft 33.

At this time also, the shaft 64 has been retracted toward the right in slots 62 and 63 to its fully retracted position, and consequently, the attached links 65, 66 and 68, 69 have likewise drawn the links 26, 27 and 38, 39 downwardly toward one another to their fully collapsed positions. At this stage the upper, load-bearing plate 41 is positioned in its lowermost position above and parallel to the base plate 11, and with opposite ends of the plate 41 disposed in vertical registry with opposite ends of plate 11.

In a typical example of this construction, it is possible to have the plates 11 and 41 spaced from one another at this stage no more than approximately 5½ inches.

When it is desired to elevate the frame 10, the valve 83 is rotated clockwise to its operating position; and a removable operating rod (not illustrated) is inserted into socket 82 and is swung horizontally back and forth in order to operate arm 81 in a manner which will cause hydraulic fluid to be pumped into cylinder 75 in order to cause its rod 76 to begin to advance out of the right end of the cylinder. Since at this time the cylinder is fixed on bar 72, any outward movement of the rod 76 from the cylinder 75 is imparted to the pin 54, thereby causing pin 54 to slide toward the right hand ends of the slots 52 and 53 in the side bars 30 and 31. This sliding movement of shaft 54 relative to the side bars 30 and 31 causes the links 55, 56 and 58, 59 to swing the attached ends of the links 16, 17 and 36, 37 away from each other about the axis of the shaft 33, and toward their fully extended positions as shown in FIG. 2. Assuming that this time the load (not illustrated) is bearing downwardly on plate 41, the base plate 11 is held stationary on the ground or like surface, so that as the links 16 and 17 begin their clockwise swinging movement, they also commence to swing the shaft 33 clockwise about the same axis. As the shaft 33 commences its swinging movement, it draws the two side bars 30 and 31 toward the right in FIGS. 1 and 2 relative to the base 11, and this movement is transmitted through the shaft 35 at the opposite ends of the frame to links 26 and 27, which also begin at this time to swing clockwise about the axis of their bolts 24, so that the left hand ends of the bars 30 and 31 swing upwardly and toward the right in unison with their right hand ends.

This swinging movement of the links 26, 27 and the shaft 35 cause the bolts 67 and 70 to be swung away from each other, and also causes the shaft 64 to slide toward the left ends of the slots 62 and 63 in the side bars 30 and 31, so that the upper ends of links 38 and 39 begin to elevate the left hand end of plate 41 simultaneously, and to the same degree, as the right hand end of plate 41 is elevated by the links 36 and 37. As a result of this operation, during the elevation of plate 41 the axes of bolts 44 and 45, which form the pivotal axes of the upper ends of the links 36, 37 and 38, 39, respectively, rise in parallel vertical planes represented in FIG. 1 by the broken lines A and B, so that the load-bearing plate 41 is caused to rise, relative to plate 11, perfectly vertically without any lateral or horizontal movement. When the plate 41 has reached its uppermost position as shown in FIG. 2, it is possible, in the case of the above-noted typical example, that it will now be spaced approximately 16½ inches from the base plate 11, so that it in effect has been elevated approximately three times the height (5½ inches) it was above the base plate when in its fully collapsed position.

Figure 5:
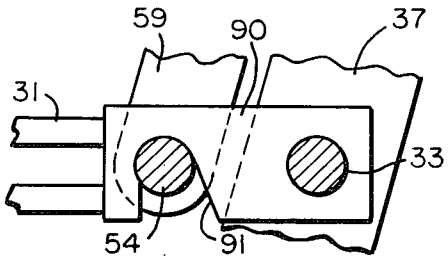
FIG. 5 is an enlarged, fragmentary sectional view taken along the line 5—5 in FIG. 4 looking in the direction of the arrows.

Pivoted at one end on the pin 33 is a locking hook or latch 90 (FIGS. 4 and 5), which has in its opposite end a curved notch 91 that is engageable over the adjacent pin 54, when frame 10 is in its elevated position, in order to lock the frame in its raised position. The latch 90 is swingable manually about shaft 33 between its locked position (FIG. 4) and released position (FIG. 1), and operates as a safety device, when in use, in the event that there should be an accidental failure of jack 74 while frame 10 is elevated.

When it is desired to collapse the frame 10, latch 90 is released, and the valve 83 is returned to its position as illustrated in FIG. 1, which thereby causes the hydraulic fluid to be exhausted from cylinder 75, so that the load (not illustrated) on plate 41 will cause the plate to descend toward the base plate 11, thereby returning the linkages to their lowered positions as illustrated in FIG. 1. Again, during this downward movement of the plate 41, the pivotal axes of the linkds 36, 37 and 38, 39, respectively, descend in the vertical planes B and A, respectively, so that no lateral movement is imparted in plate 41 during its descent, nor is there any lateral loading of the base plate 11 during this movement. Also, during both the elevation and lowering of the frame 10 the entire hydraulic pump 74 swings with the side bars 30 and 31 about the pivotal axes represented by the bolts 14 and 24, respectively, so that both the pump 74 and its supporting bars 30 and 31 move in both vertical and horizontal directions during the raising and lowering of the frame 10.

It will be noted that at each side of frame 10 the side bar 30 or 31 forms, in combination with the adjacent sides of plates 11 and 41, the common side of a double parallelogram the corners of which are represented, for example, by the center lines of the bolts 14 and 24, the shafts 35 and 33, and the bolts 45 and 44. When the pump 74 is operated, these two parallelograms at each side of frame 10 expand and contract, and assuming that at least one or the other of the plates 11 and 41 is fixed, then the common sides of the parallelograms (bars 30 and 31) will be swung relative to plates 11 and 41, and the latter two plates, depending upon which is fixed, will move one relative to the other in a vertical plane without any lateral or horizontal movement taking place between the two plates. Obviously, therefore, either plate 11 or 41 could form the base plate of the frame 10, but, for purposes of description, the base plate 11 is preferred since it is somewhat wider than plate 41, and thus somewhat more stable during use.

From the foregoing it will be apparent that applicant has devised a relatively simple and inexpensive and extremely sturdy jack having plane upper and lower surfaces, which remain absolutely parallel to each other and in vertical registry during use, and for all positions of the jack. The upper, load-bearing surface of the jack rises exactly vertically, and without any lateral or horizontal movement relative to the base plate. The sliding joints (pins 54, 64) of the jack are used to keep the movement of the top and bottom plates 11, 41 parallel to each other at all times throughout the travel of the load-bearing surface. These sliding joints slide in the common sides of the above-noted parallelograms, each side of the jack representing a collapsible double parallelogram. Moreover, the power source (the hydraulic screw jack 74) for operating the novel jack is mounted on the common sides of the parallelograms, or between the side bars 30 and 31, for movement therewith. The power source imparts motion to one of the sliding joints, relative to the common sides of the parallelogram, and in turn causes motion to be imparted to the other sliding joint so that the two joints operate in unison to effect vertical movement of the load-bearing plate.

It will be noted also that the common sides of the double parallelograms (sides 30 and 31) are always in tension as the jack is loaded, and the top and bottom sides of the jack (plate 11 and 41) always remain parallel to each other and equidistance from the side bars 30 and 31. As the lift or jack is raised, all corresponding interior angles of the double parallelograms remain equal. Moreover, it will be noted also that there are two sliding joints, and two pivotal joints located on the common sides of the double parallelograms. The well-known scissors principal is used only to transmit power from the sliding joints 54 and 64 to the principal links supporting plate 41 above plate 11.

While the preferred embodiment of the invention has been described in connection with the use of a hydraulically-operated screw jack, it will be readily apparent to one skilled in the art that the particular power supply which is used for imparting reciprocating motion to the shaft 54 is a matter of choice, and could be altered without departing from the scope of this invention. For example, instead of the hydraulically operated jack 74, a conventional mechanically-operated scissors or screw jack could be used for reciprocating the shaft 54, or any other known mechanical, electrical or hydraulic mechanism could be utilized to effect this movment.

Moreover, while the invention has been described in detail in connection with only a single embodiment thereof, it will be apparent that it is capable of further modification, and that this application is intended to cover any such modifications which may fall within the scope of one skilled in the art or the appended claims.

I claim:

1. A jack, comprising a base, an intermediate frame, a first plurality of links pivotally connected to said base and said frame to support said frame on said base for translational movement in an arc about a pair of spaced axes and between first and second limit positions, a load-bearing member, a second plurality of links pivotally connected to said frame and said load-bearing member to support said load-bearing member on said frame for movement relative thereto, drive means mounted on said frame for arcuate movement therewith and having a reciprocable driver, a third plurality of links pivotally connected to said frame and to at least certain of said first and second pluralities of links for translational movement with said frame relative to said base and said load-bearing member, and means pivotally connecting said third plurality of links to said driver and operative to impart said arcuate movement to said frame, and to reciprocate said load-bearing plate linearly toward and away from said base plate upon reciprocation of said driver.

2. A jack as defined in claim 1, wherein said frame includes a pair of spaced, parallel side members, said connecting means comprises at least one shaft extending transversely between said side members and slidably guided at opposite ends thereof in registering slots in said side members for reciprocation parallel to said driver, said driver is connected to said one shaft to impart reciprocation thereto, and each of said third plurality of links is pivotally connected at one end to said one shaft and at its opposite end to one of said certain links of said first and second pluralities thereof.

3. A jack as defined in claim 2, wherein said drive means is mounted between said side members of said frame, and between said base and said load-bearing member, respectively, and for movement in the same direction as said driver.

4. A jack as defined in claim 1, wherein said first plurality of links comprise two pairs of spaced links pivotally connected at their lower ends to opposite ends, respectively, of said base for pivotal movement about said spaced axes, one of said pairs being pivotally connected at their upper ends to one end of said frame adjacent opposite sides thereof, and the other of said pairs being longer than said one pair and being pivotally connected intermediate their ends to the opposite end of said frame at opposite sides thereof, said two pairs of links being operative to maintain a plane surface on said load-bearing member parallel at all times to a plane containing said spaced axes.

5. A jack as defined in claim 4, wherein said second plurality of links include a third pair of spaced links pivotally connected at their lower ends to said one end of said frame coaxially of the upper ends of said one pair of links and at their upper ends to opposite sides of said load-bearing plate at one end thereof, and a fourth pair of spaced links equal in length to said second pair, and pivotally connected intermediate their ends to opposite ends of said frame at said opposite ends thereof, and coaxially off the pivotal connections of said second pair with said frame, and being pivotally connected at their upper ends to opposite sides of said load-bearing plate at the opposite end thereof.

6. A jack as defined in claim 5, wherein said third plurality of links include two additional pairs of spaced links positioned adjacent each end of said frame, and pivotally connected at one end thereof to said first and second pluralities of links, and mounted at their opposite ends for pivotal and reciprocable movement relative to said frame.

7. A jack, comprising a pair of rigid plates, a first plurality of pivotal links interposed between said plates for supporting one plate movably above the other, a pair of spaced, parallel side members positioned between said plates and having a first pair of spaced, parallel pins extending transversely therebetween, and slidable at opposite ends thereof in elongate slots formed in said side members adjacent opposite ends thereof, drive means mounted on said side members between said plates and having a drive element reciprocable selectively in opposite directions between a retracted and an extended position, means connecting said drive element to one of said pins to impart reciprocation thereto, and a second plurality of pivotal links connecting said pins to said first plurality of links to impart pivotal movement thereto, said links being operative during pivotal movement thereof to swing said side members about a first pair of spaced, parallel axes fixed with respect to said other plate, and about a second pair of spaced, parallel axes fixed with respect to said one plate and movable with said one plate in spaced, parallel planes containing said first pair of axes, whereby said one plate is moved linearly between raised and lowered positions with respect to said other plate.

8. A jack as defined in claim 7, wherein each of said second plurality of links is pivotally connected at one end to one of said pins and at its opposite end is pivotally connected to one of said first plurality of links, and said side members comprise a pair of elongate, parallel members equi-spaced from said one and said other plate, respectively.

9. A jack as defined in claim 7, wherein a second pair of parallel pins extend transversely between said side members adjacent opposite ends thereof and are fixed at their ends to said side members, said first pair of pins are mounted to reciprocate toward and away from said second pair of pins during the raising and lowering, respectively, of said one plate, and a manually-operable locking member is pivoted at one end on one of said second pair of pins and has a notch therein adjacent its opposite end engageable over one of said first pair of pins, when said one plate is in its raised position, thereby releasably to lock said one plate in said raised position.

10. A jack as defined in claim 8, wherein each of said first plurality of links is pivotally connected adjacent one end to one of said side members and at its opposite end to one of said plates, and said first plurality of links include two pairs at one end of said plates, each of which is equal in length, and two further pairs at the opposite end of said plates, each of whch is equal in length, and longer than each of said two pairs at said one end of the plates, whereby said two further pairs of links are pivoted at points intermediate their ends to said side members.

* * * * *